United States Patent [19]

Skretting

[11] 4,161,501

[45] Jul. 17, 1979

[54] METHOD OF PRODUCING MECHANICALLY STRONG METAL OXIDE PELLETS

[75] Inventor: Hans Skretting, Vagsbygd, Norway

[73] Assignee: Elkem-Spigerverket A/S, Oslo, Norway

[21] Appl. No.: 753,872

[22] Filed: Dec. 23, 1976

Related U.S. Application Data

[63] Continuation of Ser. No. 614,343, Sep. 17, 1975, abandoned, which is a continuation-in-part of Ser. No. 458,717, Apr. 8, 1974.

[51] Int. Cl.[2] ..... C04B 33/32

[52] U.S. Cl. ..... 264/66; 264/56; 264/63; 264/DIG. 25

[58] Field of Search ..... 264/56, 63, DIG. 25, 264/66

[56] References Cited

U.S. PATENT DOCUMENTS

| | | | |
|---|---|---|---|
| 2,048,861 | 7/1936 | Haglund | 264/63 |
| 3,253,067 | 5/1966 | Tomita et al. | 264/56 |
| 3,886,245 | 5/1975 | Bayer et al. | 264/56 |

*Primary Examiner*—Robert F. White
*Assistant Examiner*—John A. Parrish
*Attorney, Agent, or Firm*—Eyre, Mann, Lucas & Just

[57] ABSTRACT

A method of producing sintered pellets containing metal oxide is disclosed. The pellets obtained are mechanically strong and are produced at substantially less cost than is encountered with known methods.

6 Claims, No Drawings

METHOD OF PRODUCING MECHANICALLY STRONG METAL OXIDE PELLETS

This is a continuation of application Ser. No. 614,343, filed Sept. 17, 1975, now abandoned, which is a continuation-in-part of Application Ser. No. 458,717 filed Apr. 8, 1974.

The present invention relates to a method of producing metal oxide containing pellets. The invention is of particular interest in producing mechanically strong sintered pellets in a shaft furnace from pellets which contain oxides of iron, manganese, chromium and the like.

The pellets of the present invention are consumably utilizable in smelting furnace operations. As is well known in the art, it is frequently desirable in smelting furnace operations to introduce metal oxides for various purposes. For ease of handling, greatest efficiency and to prevent dusting problems and the like, it is highly desirable to be able to introduce these metal oxide materials in pelletized form. However, because of the relatively rough handling of the pellets especially at the time of introduction and because of the high heat of the smelting furnace, it is quite desirable for the pellets to be mechanically strong so as to prevent especially the dusting problems referred to hereinbefore. As a result, the pellets are usually formed by sintering in an attempt to give them good mechanical strength. Even though the pellets are sintered, they are still consumably utilizable in smelting furnaces at normal smelting furnace temperatures, e.g., 1250° C. to 1550° C. and are thus distinguished from refractory materials which are not consumably utilizable in smelting furnace operations and quite contrarily will withstand smelting furnace temperatures.

It is, of course, known in the art to make sintered pellets which contain metal oxides. The metal oxide containing material such as magnetite concentrate is combined with a suitable binder and water and formed into pellets. The thus formed pellets are then introduced directly to the top of a shaft furnace. The pellets are dried and sintered as they sink downwards in the shaft of the furnace.

There are a number of disadvantages to this process. For example, some pellets (especially those which are produced from very fine grained material) have a tendency to burst and pulverize if they are heated too quickly in the drying zone of the shaft. This can result in disruption of operation in the shaft furnace with resultant reduced production. A further disadvantage of this known technique is that the raw pellets are liable to ball together into lumps at the top of the shaft which lumps, when they travel further down in the shaft, form crusts and this can result in hangings in the shaft. This condition is especially prevalent in the sintering of pellets which have a high moisture content and especially when the pellets or some of them are of a comparatively small size.

These disadvantages have been overcome to a degree by lowering the temperature in the shaft and by reducing the feed rate in order to reduce the formation of crusts, but the reduction of temperature leads to mechanically weak pellets and the reduction in feed rate naturally causes a drop in throughput.

The inventor has now discovered that these disadvantages to prior art processes can be avoided by first drying the pellets in a separate pre-drying apparatus at temperatures of 150°-300° C. until the moisture content of the pellets is reduced to below about 1.5%. When this pre-drying of the pellets is employed, the tendency of the pellets to burst is substantially reduced. Furthermore, it has been found that when the pellets are pre-dried, there will be substantially less tendency of the pellets to ball together into lumps. The shaft temperature can therefore be increased thus making mechanically strong pellets due to the higher sintering temperatures employed. In addition it has also been found that the fuel consumption of the shaft for the production of a ton of pellets is substantially reduced. Because of the higher temperature and the reduced fuel consumption per ton pellets, the capacity of the shaft has been increased up to three times the capacity obtained on raw, not pre-dried pellets.

The raw pellets of the present invention are formed by combining the metal oxide containing material with a suitable binder and water. Suitable binders include sulfite lye, bentonite, molasses and other known materials. The amount of water to be added will very much depend on the particular material to be pelletized. The water added should be sufficient to form pellets without being so great that the pellets do not hold their shape. It has been found, for example, that with magnetite having a specific surface of 10,000 $cm^2/cm^3$ a moisture content of about 6% is suitable.

As mentioned hereinbefore, the formed pellets are dried at temperatures of 150°-300° C. until their maximum water content is less than about 1.5%. This drying operation is carried out in a separate piece of equipment from the shaft furnace in which the pellets are sintered.

After the pellets have been dried to a moisture content of 1.5% or less, they are charged to a shaft furnace for sintering. Typical sintering temperatures which can be employed are 1,000°-1,500° C. The sintering temperature will, of course, depend upon the particular material being sintered.

Specific tests were conducted in order to demonstrate the features of the present invention. Magnetite concentrate which had been ground to have a specific surface of about 10,000 $cm^2/cm^3$ was employed. A specific surface of 10,000 $cm^2/cm^3$ is the equivalent of a very fine material of which only 1% was on 200 mesh.

The very fine magnetite concentrate was combined in one case with 2% sulfite lye and 6% water and formed into pellets. In a second case the binder employed was 1% sulfite lye and 0.5% bentonite, the amount of water again being 6%.

Batches of each of these pellets were sintered, both with and without pre-drying. The results of the tests are given in the Table on the following page.

TABLE

| Pellets | Drying Temperature | % moisture when introduced to shaft furnace | Sintering Temperature | Pressure Strength | Abrasion Strength | Throughput | Fuel Oil Consumption |
|---|---|---|---|---|---|---|---|
| (1) 2% sulfite lye binder 2% sul- | Not previously dried | 6% | 1150° C. | 90 kg | 75% | ~1000 kg/hr | 15 kg/t |

TABLE-continued

| Pellets | Drying Temperature | % moisture when introduced to shaft furnace | Sintering Temperature | Pressure Strength | Abrasion Strength | Throughput | Fuel Oil Consumption |
|---|---|---|---|---|---|---|---|
| (2) fite lye binder 1% sulfite lye | 170° C. | 0.2% | 1200° C. | 105 kg | 83% | ~3000 kg/hr | 9 kg/t |
| (3) and 0.5% bentonite as binders 1% sulfite lye | Not previously dried | 6% | 1150° C. | 95 kg | 78% | ~1000 kg/hr | 15 kg/t |
| (4) and 0.5% bentonite as binders | 170° C. | 0.2% | 1200° C. | 150 kg | 88% | ~3000 kg/hr | 9 kg/t |

As can be seen from the foregoing Table, pellets 1 and 3 were not dried before sintering whereas pellets 2 and 4 were dried in a separate apparatus from the shaft furnace to a moisture content of 0.2%. The sintering temperature in the shaft furnace is indicated in the column entitled "sintering temperature."

The "pressure strength" of the pellets is the average pressure strength of the pellets measured in kilograms of pressure they can withstand and is an indication of the way in which the pellets can withstand crumbling or breakdown. The "abrasion strength" is an indication of the tendency of the pellets to breakdown under abrasive conditions. Abrasion strength is measured by rotating the pellets 5,000 revolutions in a ribbed drum and then measuring the amount of material which is retained on a 1 mm sieve. This figure, expressed as percent, is the abrasion strength.

The "throughput" is the approximate kilograms of pellets which can be obtained from the shaft furnace in an hour. The throughput of various furnaces will be different depending upon their capacity. In the instant case the same shaft furnace was used for each of the tests and, as can be seen, a threefold improvement in throughput was obtained with the present invention.

The "fuel consumption" is given in kilograms per ton of pellets produced.

It will be understood that the claims are intended to cover all changes and modifications of the preferred embodiment of the invention, herein chosen for the purpose of illustration, which do not constitute departures from the spirit and scope of the invention.

What is claimed is:

1. In a method of producing mechanically strong pellets useful for introduction into a smelting furnace during its operation which are for consumption in smelting furnaces at furnace temperatures of from 1250° to 1550° C. from metal oxide containing material by sintering in a shaft furnace at sintering temperatures of from above 1000° to about 1500° C. comprising admixing metal oxide containing material consumably utilizable in smelting furnaces with water and binder material said water and binder being present in sufficient amount to form raw pellets which will hold their shape and forming pellets therefrom, the improvement comprising: drying the formed pellets before sintering in a shaft furnace in a drying apparatus separate from the shaft furnace at temperatures of from about 150° to about 300° C. until the moisture content of the pellets is from about 0.2% to about 1.5% whereby the tendency of the pellets to burst and pulverize or ball together into lumps during the subsequent sintering operation is substantially reduced.

2. The method of claim 1 wherein the metal oxide containing material contains material selected from the group consisting of iron oxide, manganese oxide and chromium oxide.

3. The method of claim 1 wherein the binder includes material selected from the group consisting of sulfite lye, bentonite and molasses.

4. A method of producing mechanically strong pellets suitable for introduction into a smelting furnace during its operation and which are consumable in smelting furnaces at furnace temperatures of from 1250° to 1550° from metal oxide containing material by sintering in a shaft furnace, said method consisting essentially of:

(a) admixing metal oxide containing material consumably utilizable in smelting furnaces with water and binder material;

(b) forming pellets from the admixture of step (a);

(c) drying the formed pellets in a drying apparatus separate from said shaft furnace; said drying apparatus being controlled to continuously have a temperature of from about 150° to about 300° C. temperature and continuing the drying until the moisture content of the pellets if from about 0.2% to about 1.5% whereby the tendency of the pellets to burst and pulverize or ball together into lumps during the subsequent sintering operation is substantially reduced;

(d) transferring the dried pellets to said shaft furnace; and (e) sintering the dried pellets in said shaft furnace at a sintering temperature of from above 1000° to about 1500° C.

5. The method recited in claim 1 wherein said sintering temperatures are from about 1200° to about 1500° C.

6. The method recited in claim 4 wherein said sintering temperature is from about 1200° to about 1500° C.

* * * * *